US009136577B2

(12) United States Patent
Dousset et al.

(10) Patent No.: US 9,136,577 B2
(45) Date of Patent: Sep. 15, 2015

(54) ORTHOMODE TRANSDUCER

(75) Inventors: David Dousset, Brentwood Bay (CA); Stephane Claude, Victoria (CA)

(73) Assignee: National Research Council of Canada, Ottawa, Ontario (CA)

( * ) Notice: Subject to any disclaimer, the term of this patent is extended or adjusted under 35 U.S.C. 154(b) by 274 days.

(21) Appl. No.: 13/703,046

(22) PCT Filed: Jun. 8, 2010

(86) PCT No.: PCT/CA2010/000864
§ 371 (c)(1),
(2), (4) Date: Dec. 10, 2012

(87) PCT Pub. No.: WO2011/153606
PCT Pub. Date: Dec. 15, 2011

(65) Prior Publication Data
US 2013/0088307 A1 Apr. 11, 2013

(51) Int. Cl.
*H01P 5/12* (2006.01)
*H01P 1/161* (2006.01)

(52) U.S. Cl.
CPC . *H01P 5/12* (2013.01); *H01P 1/161* (2013.01)

(58) Field of Classification Search
CPC ..... H01P 5/12; H01P 1/161; H01P 1/2131; H01Q 15/242; H01Q 15/244; H01Q 15/246
USPC ..... 333/124–129
See application file for complete search history.

(56) References Cited

U.S. PATENT DOCUMENTS 2,686,901 A 8/1954 Dicke
3,922,621 A 11/1975 Gruner
4,047,128 A 9/1977 Morz
(Continued)

FOREIGN PATENT DOCUMENTS

AU 2010355229 1/2013
CA 2042962 11/1991
(Continued)

OTHER PUBLICATIONS

Peverini, Oscar Antonio et al—2003—A Microwave Measurement Procedure for a Full Characterization of Ortho-Mode Transducers.
(Continued)

*Primary Examiner* — Robert Pascal
*Assistant Examiner* — Kimberly Glenn
(74) *Attorney, Agent, or Firm* — Jason E. J. Davis

(57) ABSTRACT

An orthomode transducer (OMT) operable in a broadband (e.g. >30%), including a frequency above ~30 GHz, with an isolation better than −50 dB, cross-polarizations better than −40 dB, an insertion loss between −0.1 and −0.3 dB for both polarizations, and return losses better than −25 dB can be produced substantially or entirely from CNC machining, comprises a turnstile for coupling a polarization diplexed waveguide with four waveguide paths; and two E-plane Y junctions each for coupling initially oppositely directed pairs of the waveguide paths such that each waveguide path has a same electrical length from the turnstile to the E-plane Y junctions as the waveguide path with which it is paired, such that the OMT is formed in 3-6 blocks, including a single block having a substantially planar mating surface that includes the matching feature, and defines one side of initial segments of the four waveguide paths. Reproducibility of these OMTs has been shown.

20 Claims, 7 Drawing Sheets

(56) References Cited

U.S. PATENT DOCUMENTS

| | | | | |
|---|---|---|---|---|
| 4,074,265 | A | 2/1978 | True | |
| 4,100,514 | A | 7/1978 | DiTullio et al. | |
| 4,162,463 | A | 7/1979 | DiTullio et al. | |
| 4,176,330 | A | 11/1979 | DiTullio et al. | |
| 4,293,829 | A | 10/1981 | Schuegraf | |
| 4,366,453 | A | 12/1982 | Schwarz | |
| 4,490,696 | A | 12/1984 | Takeda et al. | |
| 4,498,062 | A | 2/1985 | Massaglia et al. | |
| 4,717,897 | A | 1/1988 | Gehin et al. | |
| 4,749,970 | A | 6/1988 | Rammos | |
| 5,212,461 | A | 5/1993 | Alcardi et al. | |
| 5,392,008 | A | 2/1995 | Wong | |
| 5,784,033 | A | 7/1998 | Boldissar, Jr. | |
| 6,031,434 | A | 2/2000 | Tatomir et al. | |
| 6,060,961 | A | 5/2000 | Moheb et al. | |
| 6,087,908 | A | 7/2000 | Haller et al. | |
| 6,225,875 | B1 | 5/2001 | Kich | |
| 6,496,084 | B1 | 12/2002 | Monte et al. | |
| 6,600,387 | B2 | 7/2003 | Cook et al. | |
| 6,636,127 | B2 | 10/2003 | Van Meter | |
| 6,657,516 | B1 | 12/2003 | Junker et al. | |
| 6,714,165 | B2 | 3/2004 | Verstraeten | |
| 6,842,085 | B2 | 1/2005 | Chen et al. | |
| 7,019,603 | B2 | 3/2006 | Yoneda et al. | |
| 7,330,088 | B2 | 2/2008 | Aramaki et al. | |
| 7,397,323 | B2 | 7/2008 | Tavassoli Hozouri | |
| 2006/0226931 | A1 | 10/2006 | Tavassoli Hozouri | |
| 2007/0210882 | A1 | 9/2007 | Mahon et al. | |
| 2008/0129423 | A1 | 6/2008 | Han et al. | |
| 2013/0265204 | A1* | 10/2013 | Dong et al. | 343/756 |
| 2013/0278352 | A1* | 10/2013 | Mahon et al. | 333/137 |

FOREIGN PATENT DOCUMENTS

| | | |
|---|---|---|
| CA | 2284372 | 4/2000 |
| CA | 2801948 | 1/2013 |
| DE | 4437594 | 5/1996 |
| EP | 0192186 | 10/1990 |
| EP | 04588226 | 11/1991 |
| EP | 0812029 | 12/1997 |
| EP | 0993064 | 4/2000 |
| EP | 1128458 | 8/2001 |
| EP | 1158597 | 11/2001 |
| EP | 1394892 | 3/2004 |
| EP | 1154510 | 9/2005 |
| EP | 1287580 | 11/2008 |
| GB | 1591719 | 6/1981 |
| GB | 2188493 | 9/1987 |
| GB | 2219175 | 11/1989 |
| GB | 2434922 | 8/2007 |
| JP | 2005-079878 | 3/2005 |
| WO | 00/16431 | 3/2000 |
| WO | 01/91226 | 11/2001 |
| WO | 03/079483 | 9/2003 |
| WO | 2007/088183 | 8/2007 |
| WO | 2008/008702 | 1/2008 |
| WO | 2008/012369 | 1/2008 |
| WO | 2010/061008 | 6/2010 |
| WO | 2011/153606 | 12/2011 |

OTHER PUBLICATIONS

Natarov, M.P. et al—2004—Orthomode Transducer for MM-Wave Range.
Rebollar, J.M. et al—1998—A dual frequency OMT in the Ku band for 'IT&C applications.
Wu, X. & Dou, W. B.—2007—Research on a Compact Millimeter Wave Ortho-Mode Transducer.
Yoneda, Naofumi et al—1999—A 90GHz-Band Monoblock Type Waveguide Orthomode Transducer.
Chattopadhyay, Goutam et al—1998—A 96-GHz Ortho-Mode Transducer for the Polatron.
Deronde, F. C.—1966—Full Band Matching of Waveguide Discontinuities.
Steffe, Walter—1995—A Novel compact OMJ for Ku Band Intelsat Applications.
Skinner, Stephen J.—1991—Wide-Band Orthomode Transducers.
Navarrini, A.—2003—Design of a Dual Polarization SIS Sideband Separating Receiver based on waveguide OMT for the 275-370 GHz frequency band.
Peverini, Oscar Antonio et al—2006—Orthomode Transducer for Millimeter-Wave Correlation Receivers.
Grammer, W. et al—2002—The Boifot Orthomode Junction.
Wollack, E.—1996—A Full Waveguide Band Orthomode Junction.
Narayanan, Gopal—2003—Full-Waveguide Band Orthomode Transducer for the 3 mm and 1 mm Bands.
Banham, R.—2005—Electroformed Front-end at 100 GHz for Radio-astronomical Applications.
Meyer & Goldberg—1955—Applications of the Turnstile Junction.
Sharma, Shashi Bhushan—2005—Multifrequency Waveguide Orthomode Transducer.
International Preliminary Examination Report—PCT/CA2010/000864—Jun. 8, 2010.
International Search Repprt—PCT/CA2010/000864—Jun. 8, 2010.
Aramaki, Yoji—2003—Ultra-Thin Broadband OMT with Turnstile Junction.
Mauskopf, Philip—2008—Clover Polarimetric Detector | A Novel Design of an Ortho-modeTransducer at 150 and 225 GHz.
Pisano, Giampaolo—2007—A Broadband WR10 Turnstile Junction Orthomode Transducer.
Navarrini, A. and Nesti, Renzo—2009—Symmetric Reverse-Coupling Waveguide Orthomode Transducer for the 3-mm Band.
Navarrini, A and Plambeck, R.—2006—A Turnstile Junction Waveguide Orthomode Transducer.
Moorey, G.—2006-A77-117 GHZ Cryogenically Cooled Receiver for Radioastronomy.
Nesi, Renzo—2006-2007—Orthomode Transducer at 43 GHZ.
CSIRO—Jul. 12, 2005—Prototypes and Services.
Claude, S.—Oct. 8, 2008—HIA Millimetre Instrumentation—Part 1.
Claude, S.—Oct. 8, 2008—HIA Millimetre Instrumentation—Part 2.
Claude, S.—Oct. 8, 2008—HIA Millimetre Instrumentation—Part 3.
Claude, S.—Jun. 8, 2009—Band1 Poster.
Rebollar,J.M. et al.—1998—A dual frequency OMT in the Ku band for TT&C applications—Antennas and Propagation Society International Symposium, vol. 4, 2258-2261.

* cited by examiner

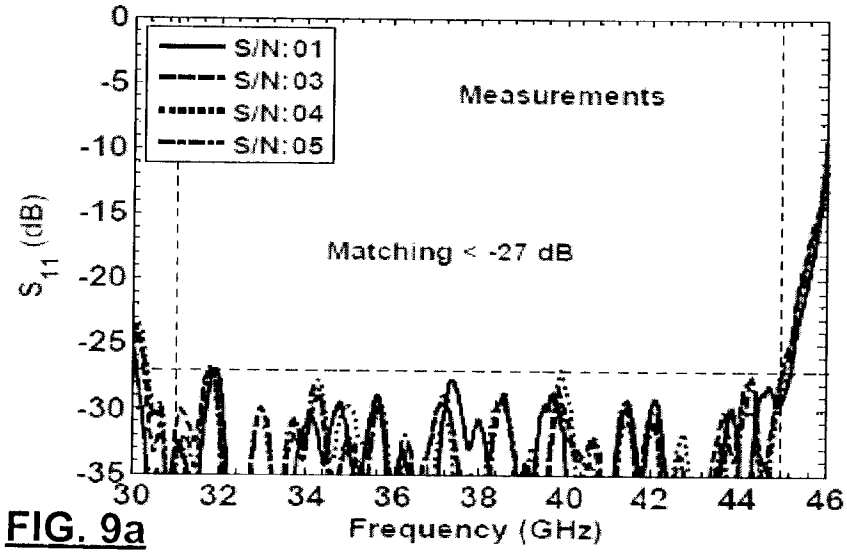
FIG. 9a
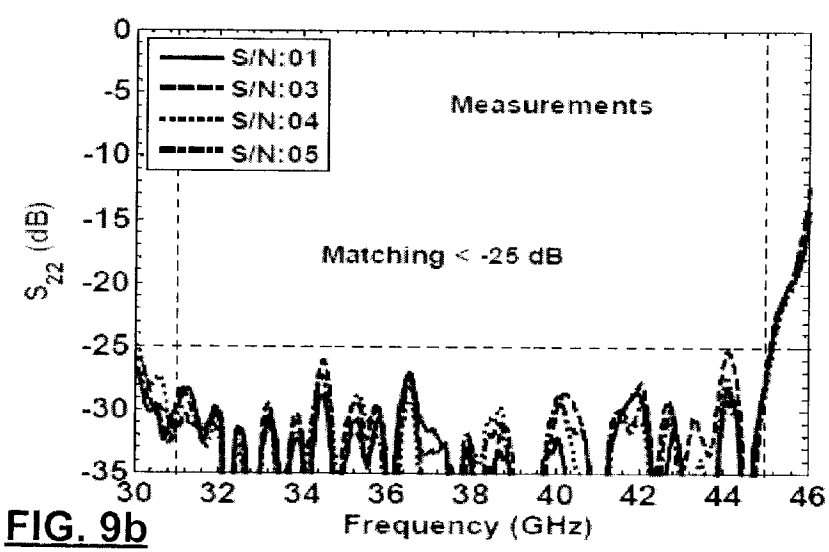
FIG. 9b
FIG. 9c
FIG. 10

ORTHOMODE TRANSDUCER

This application is a national phase entry of International Application PCT/CA2010/000864 filed Jun. 8, 2010. The entire contents of which are herein incorporated by reference.

FIELD OF THE INVENTION

The present invention relates in general to radiofrequency electromagnetic waveguide devices for polarization mode separation or recombination and, in particular, to an OMT design that is easy to fabricate and assemble with high precision, and can be scaled for frequencies above 30 GHz to at least 500 GHz.

BACKGROUND OF THE INVENTION

A well known problem in radiofrequency (RF) astronomy is how to separately investigate both polarization modes from a RF source. Orthomode transducers (OMTs) are used to de-diplex incident electromagnetic (EM) radiation. In many other applications there is need for polarization diplexers and de-diplexers. Generally low return loss, high isolation and low cross-polarization OMTs are desired. While it is also generally desirable to reduce insertion loss, this loss is mostly attributed to conduction losses within the waveguide structure, and so is principally determined by the materials, and less so by the design, and are rather small. As return loss, cross-polarization and isolation depend on wavelength, there is a need for OMTs that provide acceptable quality in each respect over an intended operating range. In some cases the operating range is narrow band, but in many cases the broader the band the better. All OMTs are trade-offs in these features along with costs of production and assembly, and reliable operation.

A chief component of OMTs that can be used to classify them is the (principal) junction, which connects a polarization diplexed waveguide with at least 2 paths. Some OMT designs use a turnstile junction while other OMT designs use Boifot junctions or double ridge junctions.

The Boifot junction is a relatively complex device that requires two pins and a septum (three matching elements) or an iris to be positioned within the waveguide. Features such as the matching pins, septum, or iris, increase return loss, increase an expense of the device, complicate assembly, limit the bandwidth over which the OMT operates, and limits the smallest size the OMT can obtain (and/or the fabrication techniques that can be employed to produce them), limiting low cost production of higher frequency band OMTs. Higher frequency OMTs require smaller devices, and greater accuracy of the definition of the matching elements, which is increasingly difficult to produce. Moreover, the septum is a mobile piece and the return losses of the OMTs are therefore prone to change when the septum is moved out of alignment.

There are several commonalties between the Boifot and double ridge OMT structures. In both cases, two arms are fundamentally different: one arm is provided by a pair of (initially oppositely directed) waveguides that are subsequently reunited, and the other arm is never divided. The double ridge design also requires intricate features (on both sides of the waveguide) that are also more difficult and expensive to produce and assemble, and increasingly so at smaller scales (higher frequencies). As matching features have to be provided on two or more parts and as there are very low-tolerances for the alignment of these features, it is unsurprising that these designs fail to produce high quality OMTs with good repeatability, especially at higher frequencies (i.e. above 30 GHz).

For example, Double-Ridged OMT (Shin'iciro Asayama National Astronomical Observatory of Japan) according to which ridges are provided from above and below an input waveguide shows a design that is, in principle, scalable to smaller dimensions and higher frequencies. While 7 examples were produced and all have apparently the similar reflection losses, cross-polarization over the band from 110-170 GHz varies from −24 to −40 dB depending on the example, and over ALMA band 4, varies from −28 to −42 dB. Having matching elements produced on multiple parts complicates production and assembly and leads to small errors that can affect reproducibility and/or quality of the OMT. The problems with repeatability may be caused by the fact that the matching elements are provided in multiple parts.

A turnstile junction is a waveguide network with a diplexed waveguide port (+z axis) and two paired perpendicular waveguide paths (+,−x axis, and +,−y axis). A matching (or tuning) element (or feature having one or more elements) is provided at the origin where these waveguide paths meet, opposite the diplexed waveguide port. To produce an OMT, the oppositely directed pairs of waveguide paths are made to recombine after traveling equal electrical path lengths, and the recombined paths communicate with respective ports. Thus there are three ports, one for s-polarized signal, one for p-polarized signal, and one for the diplexed signal.

Various matching features are known for turnstile junctions, including a trunked pyramid (as used by Navarrini et al. described below), and concentric cylinder matching stubs (e.g. M. A. Meyer et al. entitled "Applications of the Turnstile Junction" IRE-Transactions on Microwave Theory and Technique pp. 40-45, December 1955).

Among the OMT literature surveyed by the Applicant, there was only one device that was able to offer very good cross-polarization and isolation. It was taught by Navarrini et al. in "A Turnstile Junction Waveguide Orthomode Transducer" IEEE Transactions on Microwave Theory and Technique, v.54, Not 2006. The OMT was designed for the 18-26 GHz frequency range, and across this range, the insertion loss was 0.15 dB, and the cross-polarization was less than −47 dB for both polarizations. While it may be desirable to improve on the return loss of (−19 dB), it represents a major improvement over the available alternatives. The model of this OMT includes one 180° bend for each of the 4 waveguide paths from the turnstile so that the paired waveguide paths are convergent, and the pairs are then coupled by E-plane Y power combiners. The OMT is divided into 4 parts that are assembled as 4 quarters, each having an edge that meet along a center axis that passes through the center of the diplexed waveguide.

When Navarrini (Test of 1 mm Band Turnstile Junction Waveguide Orthormode Transducer, 17*th Int. Symp. on Space Terahertz Technology* P1-21) attempted to miniaturize the same design, to produce an OMT for use in the 200-270 GHz frequency range, the transmission loss was 0.8 dB, the return loss was −12 dB and the cross-polarization was lower than −25 dB for both polarizations. This device is not nearly as successful as the 18-26 GHz frequency range device.

There are other OMT designs known in the art that use a turnstile junction with matching feature as the principle divider. Some are appreciated for their compactness, and low part count, but deliver (or even fail to deliver) marginal quality polarization diplexing or de-diplexing, i.e. return loss, cross-polarization and isolation from −20 to −25 dB, even over lower bandwidths. The low quality of the many known turnstile-based OMT designs, Navarinni's first design excluded, and the non-scalability of Navarrini's device would lead research away from this design. Some examples of low quality turnstile-type OMT designs and their noted features include U.S. Pat. No. 7,397,323 to Hozouri and a paper to Aramaki et al. entitled "Ultra-Thin Broadband OMT with Turnstile Junction" (also patented U.S. Pat. No. 7,330,088 and U.S. Pat. No. 7,019,603).

U.S. Pat. No. 7,397,323 to Hozouri teaches a waveguide orthomode transducer having at a first layer, a turnstile junction having a main waveguide and four waveguide ports, each coupled to a respective magic-T with an E-port, two opposed side-ports, and an H-port. The magic-Ts (called therein hybrid Ts) are ring-arranged around the turnstile junction so the waveguide ports each communicate with one H-port, so adjacent magic-Ts inter communicate with their respective side-ports, and so the E-ports form two sets of opposed E-ports. In a second layer two H-plane power dividers/combiners each have an axial-port and two opposed side-ports. The H-plane power dividers/combiners are arranged so their respective side-ports communicate with different ones of the two sets of opposed E-ports and so their axial-ports are polarization ports. This permits a single signal with two fundamental orthogonally polarized modes to enter the main waveguide and exit separated at the polarization ports, and vice versa.

This design is stated to be advantageous in that it provides a compact and thin waveguide OMT, and that it is easy to manufacture, however no explanation as to how it would be manufactured is taught or suggested. Furthermore, no example is provided, and no data regarding signal power, isolation, mode purity, bandwidth, voltage standing wave ratio, or any other feature (except profile height, which is not supported by any simulation or other data).

In any case, the ring coupling of the 4 turnstile arms is expected not to provide low return loss, isolation, or low cross-polarization, because of the use of magic-T junctions. Magic-T couplers typically have theoretical return losses of about −20 dB over a 22.4% bandwidth (−30 dB minimum at a point), if the magic-T is properly matched (in this case with an inductive post), and is never better than about −5 dB without the matching element. FIG. 1 is a graph showing simulated return losses for a magic-T coupler, with and without an inductive post matching feature. It will be noted that unmatched magic-Ts have high return losses that constitute impermissible losses in many applications. Furthermore these losses can result in standing waves that lead to internal arcing, which must be avoided, for example, by limiting a power the OMT can handle safely. Matching features (inductive post, iris, reflectors or matching screws) can be added to the magic-T to reduce reflection losses. Such matching features are typically expensive to manufacture or position, and, while they may significantly reduce return losses (reflection), this improved loss is typically over a narrow bandwidth. The inclusion of these elements must be precisely aligned. As they are formed on different planes of different parts, this complicates alignment within required precision. Furthermore these features also limit the power the OMT can safely diplex/dediplex. Hozouri does not mention any matching element, without which the device has a theoretically optimal return loss of about −5 dB.

In Hozouri's example, each magic-T junction is used twice. The magic-T is first used as a (polarization neutral) H-plane divider, to divide the output of the turnstile into R and L signals, and to couple these R and L signals to the ring (in opposite directions). Then the magic-T is used as an E-plane combiner for combining +L with −R (or vice versa) from the other two adjacent turnstile outputs, and sending the combination up to the next level. Thus, twice the return loss of the magic-T is imparted to the incoming signals. Finally, the +L-R signal is combined with the −L+R signal in the second plane using a third T or magic-T junction. These losses, over the Ku band (12.4-18 GHz), are substantial.

The paper to Aramaki et al. shows a turnstile junction-based OMT that can advantageously be defined in 3 pieces. Like Hozouri, Aramaki et al. have illustrated the E-plane power combiners for each arm as a T coupler. T couplers are very poor quality junctions, and are never better than the magic-T couplers described above. Unfortunately, it is impossible to replace such couplers and have the desired parts count. For example, in both cases, replacing these T couplers with more complex structures would require at least 2 more pieces, or will not permit low cost fabrication equipment to be used. T couplers are typically higher reflection than magic-T couplers, and result in the same standing wave problems that limit power handling of the OMT.

The best example from Navarrini et al. is operable in the 18-26 GHz range, and the other (200-270 GHz) does not provide acceptable signal quality for some applications. The double ridge and Boifot type OMTs are not scalable to higher frequencies and cannot be produced with low cost forming techniques.

Thus there remains a need in the art for an OMT capable of high quality (low return loss, cross-polarization and isolation) without multiple matching elements that complicate manufacture, limit operating range, and increase cost. Especially desirable is an OMT that operates over a broad frequency range, a frequency range that includes frequencies above about 30 GHz, or one that can be machined and assembled with high accuracy with relative ease.

SUMMARY OF THE INVENTION

Applicant has discovered, unexpectedly, that excellent quality OMTs can be produced by avoiding a requirement to align matching features on multiple parts, and using a turnstile and 2 E-plane Y junctions as the junctions for the OMT. Furthermore these modifications ensure that sensitive features, such as the diplexed signal port, and especially the matching feature, can be provided on one surface of one part, as opposed to being defined at an interface between multiple parts, as in Navarinni. This facilitates miniaturization and the production of higher frequency OMTs, such as those operating at a range that includes frequencies above about 30 GHz to frequencies above 500 GHz.

The quality of the higher frequency OMT produced with basic CNC machining was surprising, in that it provides higher quality polarization de-diplexing/diplexing than any prior art example.

Accordingly, an OMT is provided, comprising: junctions consisting of: a turnstile junction with a matching feature for electromagnetic coupling of a polarization diplexed waveguide with four waveguide paths; and two E-plane Y junctions, each Y junction coupling a pair of the waveguide paths that are oppositely directed at the turnstile junction, and paired waveguide paths extending between the turnstile junction and respective Y junctions, each waveguide path being paired with a waveguide path having a same electrical length between the turnstile and the respective E-plane Y junction; wherein the OMT is formed in 3, 4, 5, or 6 blocks, including a single block having a substantially planar surface that: meets the turnstile junction and includes the matching feature; and defines part of initial segments of the four waveguide paths.

The OMT may be operable between 31-45 GHz with an isolation better than −50 dB, return losses better than −25 dB, cross-polarizations better than −40 dB, and an insertion loss from about −0.1 to about −0.3 dB, or have similar quality at similar bandwidths at higher frequencies.

The paired waveguide paths of one or both of the pairs may be symmetric, or asymmetric, and all waveguide paths may all be of equal electrical length. One of the waveguide paths may follows one of the following bend sequences: EE, HH, HHEE, HEEEEH, and HEH. The segments of one of the waveguide paths may consist of uniform cross-section straight segments.

The E-plane Y junctions may be defined by 2 mating surfaces on distinct blocks in a plane of the Y junction that includes paths of three ports of the Y junction, whereby Y junctions can be machined without high aspect ratio bits. This plane may be parallel to the turnstile plane, or the Y junction may be parallel or collinear with the diplexed waveguide. The Y junction may have a 4 section transformer between a coupled port and a junction region, may have a compact multi-part miter bend or stepped tight corner bend on each of the two decoupled ports that lead to a junction region of the Y junction; and may exhibit a −40 dB return loss over a 40% bandwidth.

The matching feature may comprise at least one cylindrical feature extending from a base towards the polarization diplexed waveguide, a stub having two solid cylinders, or a trunked solid pyramid, placed along a central axis of the polarization diplexed waveguide, for example with a height of about 30-70% of a height of the waveguide path; and may further comprise one or more elements surrounding the stub substantially midway between the stub and the projection of the polarization diplexed waveguide.

The OMT may be formed in 3, 4, 5 blocks machined only by CNC machining, formed in 3 blocks assembled by stacking, by only surface forming and drilling throughbores in the blocks, formed in 3 blocks assembled by stacking, by only surface forming on two surfaces between the blocks and drilling throughbores in the blocks; formed in 3 blocks assembled by stacking in a direction of the diplexed waveguide, by only surface forming on two surfaces of the blocks that are perpendicular to the diplexed waveguide, and drilling throughbores in the blocks in the direction of the diplexed waveguide; formed in 2 or 3 blocks by drilling throughbores in the blocks, and surface forming on at least two adjacent sides of one of the blocks; formed in 2 or 3 blocks by drilling throughbores in the blocks, and surface forming on at least two adjacent sides of one of the blocks, and the OMT is assembled by abutting a flat surface against one of the adjacent sides; formed in 2 or 3 blocks by drilling throughbores in the blocks, and surface forming on at least two adjacent sides of one of the blocks, and the OMT is assembled by abutting a flat surface against one of the adjacent sides, and stacking a remainder of the blocks with the one of the blocks; formed in 2 or 3 blocks by drilling throughbores in the blocks in the direction of the diplexed waveguide, and surface forming on at least one surface perpendicular to the diplexed waveguide, and two surfaces that are perpendicular to the at least one surface, and the OMT is assembled by abutting a flat surface against both of the two surfaces that are perpendicular to the diplexed waveguide, and stacking the blocks in the direction of the diplexed waveguide; formed by surface forming at least two mutually sides of a first block that are not oriented perpendicular to the diplexed waveguide, drilling throughbores in the first and second blocks, and surface forming at least one surface perpendicular to the diplexed waveguide on the first or second block, stacking the first and second blocks against the at least one surface perpendicular to the diplexed waveguide, and abutting flat surfaces against two of the three mutually adjacent sides of the first block; formed by surface forming three mutually adjacent sides of a first block, drilling throughbores in the first block, drilling throughbores in a second block, stacking the first and second blocks, and abutting flat surfaces against two of the three mutually adjacent sides of the first block; or formed by surface forming on at least two adjacent sides of each of the 2 blocks, and the OMT is assembled by abutting a flat surface against one of the adjacent sides of each, and stacking a remainder of the blocks with the one of the blocks.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which:

FIGS. 8*a-d*, 9*a-c*, and 10 are graphs of 4 test OMTs, respectively showing insertion loss and cross-polarization, impedance matching, and isolation.

DESCRIPTION OF PREFERRED EMBODIMENTS

Herein several terms are used as mathematical idealizations, including references to orientations (perpendicular, parallel). As will be appreciated by those of skill in the art, these are indicative of the objective of the design and not a suggestion that mathematical perfection is achievable. A range of tolerances that depend on the intended application can be chosen.

An OMT is described having improved quality, low cost manufacture and assembly, and is capable of operation over a broad bandwidth (such as at least 30%, preferably 35%, more preferably 40%, and even over 40% has been achieved) including frequencies above about 30 GHz, where bandwidth is defined as the percent ratio of span (i.e. $f_{max}-f_{min}$) to the center frequency ($f_{min}-\frac{1}{2}(f_{max}-f_{min})$).

OMT Design

Figure 1:
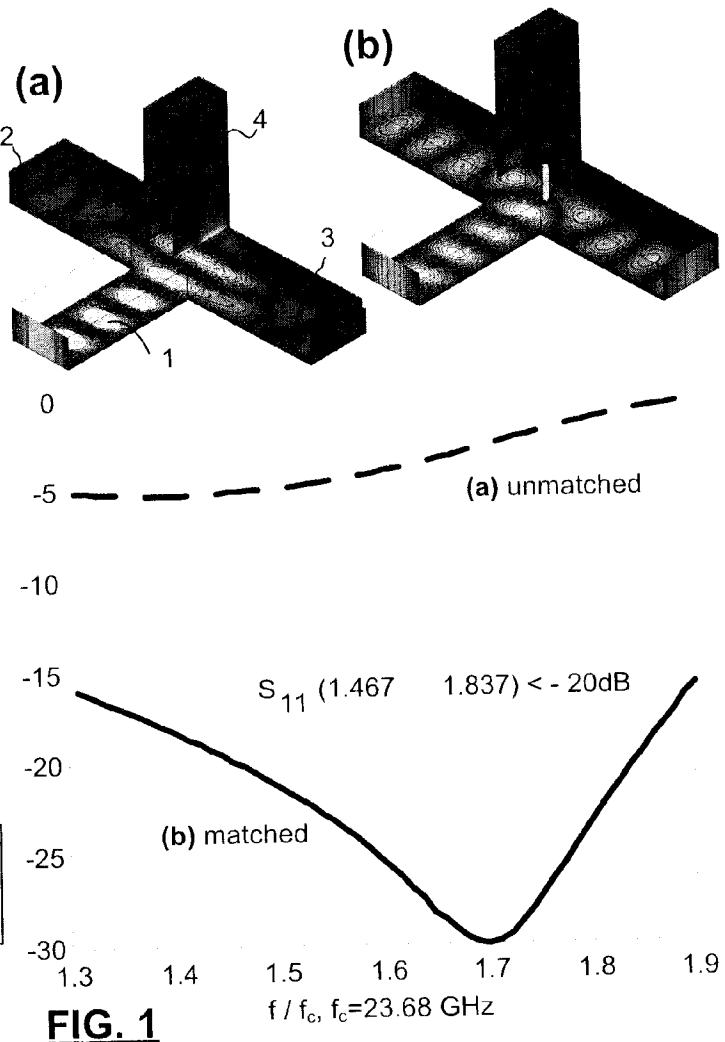
FIG. 1 includes scalar E-field diagrams of (a) an unmatched magic-T coupler and (b) a matched magic-T coupler, along with a graph showing insertion loss as a function of normalized frequency, showing limitations of T and magic-T couplers.
Figure 2:
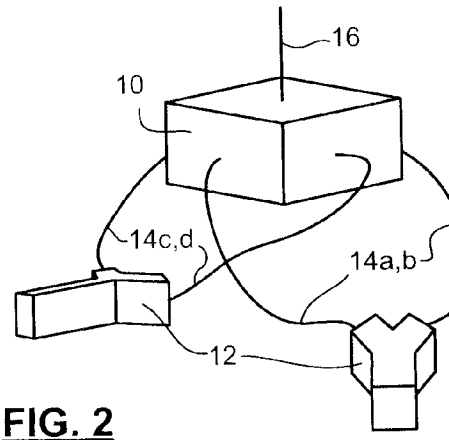
FIG. 2 is an illustration of a highly schematic representation of an OMT in accordance with an embodiment of the invention.

FIG. 2 is a schematic illustration of the overall OMT design in accordance with the invention. The OMT uses a turnstile 10 as the principal junction, which couples polarization diplexed waveguide 16 and four waveguide paths 14*a,b,c,d*. The waveguide paths 14 as they exit the turnstile 10 are perpendicular to the diplexed waveguide 16, paired waveguide paths 14*a,b*, and 14*c,d* are oppositely directed, and unpaired waveguide paths 14*a,c*, 14*a,d*, 14*b,c*, and 14*b,d* are perpendicular. As such, the directions of the diplexed waveguide 16 and waveguide paths 14 coordinatize 3 space with the diplexed waveguide 16 in the positive z direction, waveguide paths 14*a,b,c,d* going in +x,−x,+,+y,−y directions, respectively. The turnstile has a matching feature that reduces return losses of the polarization diplexed waveguide, as is described further herein below.

The paired waveguide paths 14*a,b* (and likewise with paired waveguide paths 14*c,d*) include bends in a manner known in the art of waveguide construction, such that the paired waveguide paths rejoin at an E-plane Y junction 12. As illustrated, the bending of the paired waveguide paths 14 is entirely schematic, however, it is necessary that the electrical lengths of each waveguide path be the same as that of its paired waveguide path, in order to provide constructive interference, as will be appreciated by those of skill in the art. A wide variety of examples of layouts are possible to achieve this result, some of which are described herein below.

The waveguide, turnstile, and Y couplers may be milled from solid blocks or surface formed by precision molding, stamping or engraving, using such techniques as electrical discharge machining, electroforming, etching with lasers or chemical etchants, and possibly casting or forging, depending on the tolerances required, the material used, and the dimensions of the features. The material may be formed of a plastic but be coated with a surface conducive to operation in an OMT. The waveguide paths 14 are preferably formed by straight path sections of uniform cross-section segmented by 2 or more bends that can be characterized as H-plane or E-plane bends (i.e. bends are only in planes perpendicular or parallel to the x, y and z coordinates), although this is not essential. In the illustrated embodiments the bends are all 90° or 180° bends, but this is not essential. The straightness of the path segments, 90° bends, and orientation of the bends in planes perpendicular/parallel to the coordinates, are all preferred because of the ease of manufacture, and reproducible quality parameters.

Naturally each component of the OMT design increases reflection losses, and cross-polarization, and decreases isolation of the OMT, in operation. Some components are more sensitive than others. For example, substantially uniform cross-section, straight waveguides (square profile is used, although this is not essential) contribute very little to the losses. In the designed and produced examples herein, the return losses of the components are substantially ordered as follows: Turnstile junction with matching feature (~−30 dB); E-plane power combiner (~−40 dB); bends (~−45 dB); and an optional transformer of the diplexed waveguide (~−55 dB).

Each component of this device was simulated and provides return loss across a 38% bandwidth that is believed to be scalable to frequencies up to 500 GHz. The techniques for forming can advantageously be CNC machining.

Matching Elements

The turnstile junction of the illustrated embodiments includes a matching feature that is designed to reduce return losses, and efficiently couple electromagnetic radiation from the polarization diplexed waveguide to the waveguide paths, and vice versa.

While various features are known in the art, and still more may yet be defined that have particular advantages for specific applications, Applicant considered 4 matching features for broadband OMTs: a cubic feature, a cubic feature with 4 pins, a truncated pyramid, and a cylindrical feature. Nonetheless Applicant envisages variations on these features including: 3 superimposed cylinders, a cone, and the addition of peripheral elements (such as the 4 pins) to any of the above features. Typically matching features have at least 4 fold symmetry such that each 90° section of the matching feature associated with a respective waveguide port, is the same.

FIG. 2 schematically illustrates these 4 matching features. The specific turnstile illustrated has a circular polarization diplexed waveguide (diameter 7.42 mm), and waveguide paths having a width of 6.33 mm, and a height of 3.25 mm. FIG. 2*a* schematically illustrates a cubic matching stub in a turnstile. The cubic stub has square lengths 2.97 cm, and a height of 1.27 cm. This type of matching feature has a return loss profile (as determined by simulation) over a frequency range of 30-44 GHz that is less than −24 dB. FIG. 2*b* has, in addition to the stub, 4 pins, acting as inductive posts, that are positioned midway between corners where the waveguide paths meet, and corners of the stub. The pins have diameters of 0.3 mm and height of 0.4 mm. The addition of these pins decreases the return loss to −24.2 dB and extends the range over which this return loss is provided beyond 46 GHz, as determined by simulation.

FIG. 2*c* schematically illustrates an idealized matching feature used by Navarrini et al. adapted to the turnstile dimensions and wavelength band of 30-45 GHz. The cubic section has sides 2.667 mm long, and a height of 0.575 mm. The base section has a height of 0.84 mm and a profile contour from a 4.56 mm base to the 2.667 mm top having a fillet radius of 1.3 mm, on all four sides. By simulation this design is found to provide a return loss of −25 dB at least from 30-45 GHz FIG. 2*d* schematically illustrates a matching feature currently preferred, at least for operation within the 31.3-45 GHz ALMA band 1. The feature includes two concentric cylinders: the base cylinder having a diameter of 4.895 mm, and a height of 0.682 mm, and the top cylinder having a diameter of 2.2 mm, and a height of 1.293 mm. Over ALMA band 1, the return losses are less than −30 dB. From 31.8-45 GHz the return losses are less than −33 dB, return losses are −35 dB across 82% of the ALMA band 1 (i.e. from about 32.7-44.7 GHz) and −40 dB across 71% (i.e. from about 33.9-44.3 GHz), and about −42.4 dB or less from about 34.4-44.2 GHz, i.e. over ⅔ of the ALMA band. The return losses are minimum in the neighborhoods of 36 GHz, and 43.5 GHz.

Given the improvement provided by the 4 pins on the cubic stub, where the 4 pins are arranged substantially midway between the stub and the (projected) limits of the polarization diplexed waveguide, it is possible that other stubs may have return losses improved by inclusion of these or one or more other elements around the stub.

In accordance with an aspect of the invention, the OMT is formed of at least 3 blocks that are assembled to form the OMT. Two of the blocks have mating surfaces defining an interface. The interface defines the turnstile, including at least the matching feature and an initial part of the 4 diverging waveguide paths.

By avoiding the quartered-block arrangement of Navarrini et al., which produces parts of the matching stub on each of the blocks, alignment and assembly is greatly facilitated. Advantageously, the matching feature can often be provided by machining without any special bits. While this is advantageous, it will be appreciated that for OMTs adapted to other bands, and for applications requiring lower return losses, for example, matching features may alternatively be provided in other ways. The matching feature does not need to be machined into the mating surface of the single interface that defines the turnstile, but may include elements that are smaller or more delicate than can be produced by CNC milling, for example. On a single part, it is possible to place the matching feature in a number of ways, including laser ablation or using other fine resolution machining techniques.

Each component of this device was simulated and provides return loss across a 38% bandwidth that is believed to be scalable from frequencies as high as 500 GHz. With more exotic machining or other forming techniques, higher frequency OMTs can be produced. The techniques for forming can advantageously be CNC machining, which can provide features having dimensions as small as 60 μm with a tolerance of +/−5 μm.

While the foregoing examples are advantageous in that they can be milled by CNC machining, like all of the other parts of the OMT, making for simplified fabrication, an advantage of the present design is that all of the matching elements are provided on one part, and on one surface thereof, and that unrestricted access is provided to this surface when the OMT is in disassembled form. A wide variety of stubs and features in general are possible with the variety of deposition techniques available, and the stubs may be composed of materials having similar thermal expansion coefficients but different permeabilities and permittivities resulting in different effective refractive indices. These exhibit different abilities for redirecting electromagnetic radiation of different radiofrequencies and modes. Continued research into higher frequency bands are expected to yield different features that are particularly applicable to different bands.

E-Plane Y Junction

Figure 4:
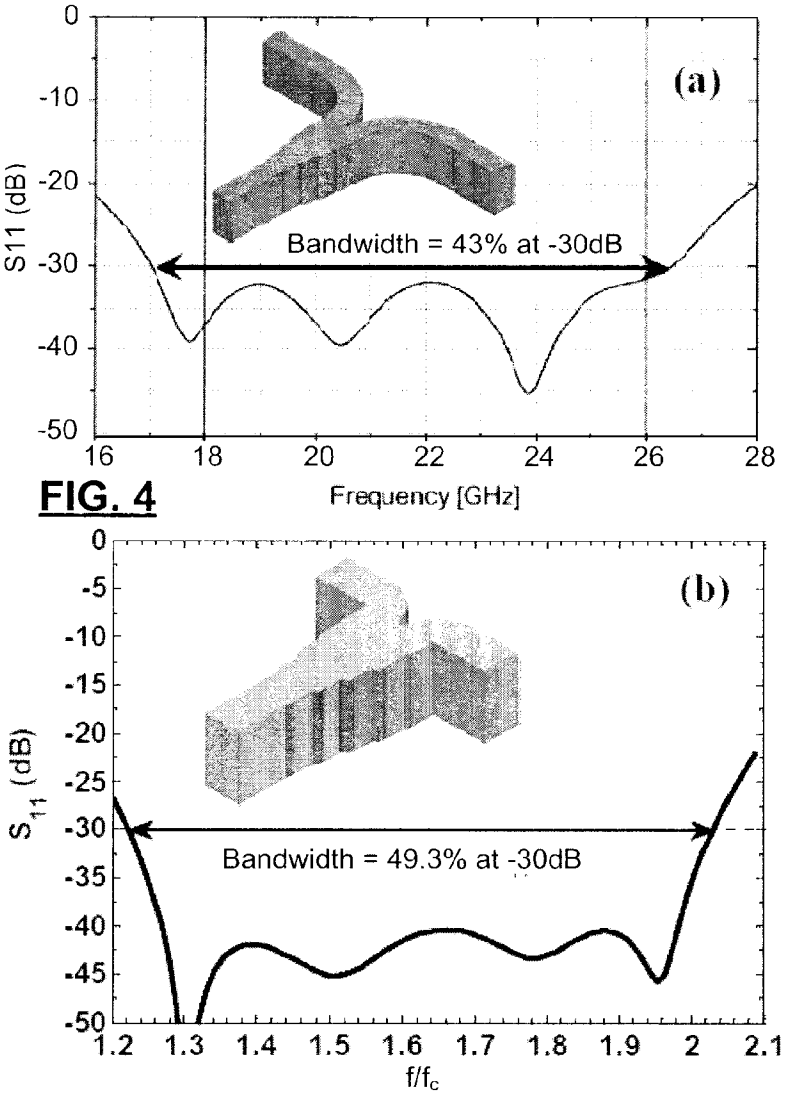
FIG. 4 shows comparative graphs 4(*a*) and 4(*b*) of two E-plane Y junctions that can be incorporated in an OMT in accordance with the present invention.

Applicant has chosen a design for the E-plane power combiner that has advantages over Navarrini's design, in terms of compactness and performance. As will be seen in FIG. 4(*a*), Navarrini's E-plane Y junction uses radially curved arcuate bends leading the two decoupled ports to a junction region, and employs a 3 section impedance transformer between the coupled port and the junction region. FIG. 4(*b*), in contrast, shows a 4 section transformer section, and employs a tight corner (right angle inside) bend that is defined by a 3-part miter corner. It will be appreciated that a different number of miter parts could alternatively be used, especially a higher number, and alternatively a multi-step corner could be used, and may be preferred, depending on the direction of machining, the equipment used for machining, and performance requirements.

Figure 3:
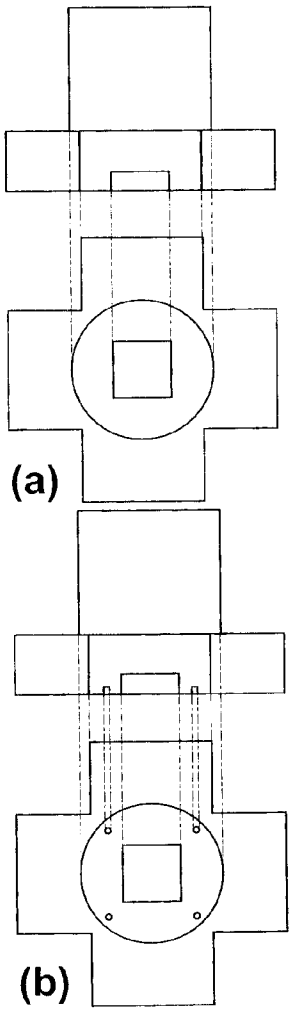
FIG. 3 show schematic illustrations of plan and elevational views of each of 4 exemplary embodiments of matching elements, within a turnstile junction, that can be incorporated in an OMT in accordance with the present invention.

Graphs in FIGS. 4(*a*) and 4(*b*) show how simulated results in the ALMA band 1 demonstrate a markedly lower return loss for this more compact E-plane Y junction. The prior art example by Navarrini had a −30 dB return loss across a 43% bandwidth. FIG. 3(*b*) shows two embodiments of E-plane Y junctions: one with a 3-part mitre septum/bend, and one with a 2 step septum/bend. Both use a 4 step impedance transformer. The 2 step Y junction exhibits a 48.7% bandwidth with a return loss of −30 dB, a −39.5 dB return loss over a 32% bandwidth, and a −42 dB return loss over a 25% bandwidth. The 3-part mitre Y junction exhibits a −40 dB return loss across a 44% bandwidth and a 49.3% bandwidth at −30 dB. Simulations demonstrate a substantially lower return loss for this more compact E-plane Y junction.

It will be noted that this design can advantageously be milled and/or drilled into a solid workpiece from 2 directions with respect to the plane of the Y junction (i.e. the plane in which the letter Y is formed). When the plane of the Y-junction lies between two mating surfaces of adjacent parts, the milling can be provided in the direction of the H-field; and where the two mating surfaces sever the Y junction around the junction region, such that a septum of the Y junction is defined by a first part and the entire transformer section is defined by another, the milling is provided in a direction (k) of the waveguide if the blocks are aligned in a stack, and thus access is only provided at two surfaces. Alternatively the Y junction oriented parallel to the diplexed waveguide and offset from the axis of the diplexed waveguide may be provided on a side of the block defining the diplexed waveguide, and/or the matching feature. The Y junction design with arcuate bends (FIG. 4(*a*)) can be milled from only one side (the direction of the H plane). Furthermore, the Y junction of FIG. 4(*b*) permits a more compact arrangement, which is generally desirable of OMTs. Given a distance between the junction region and the coupled port, a high aspect ratio bit may be required to machine this part, when it is produced end-on. As this may contribute to errors in the device, higher rigidity (specialty) bits may be required, or the part in which the device is machined may be diced transversely to the axis of the Y junction. This permits different stages of the transformer to be defined at different mating surfaces of the parts, and removes the requirement to use longer or higher aspect ratio bits. Furthermore, the sections of the transformer may be provided in separate planar parts having through holes. These solutions increase the parts count and may add to the requirements for alignment, and present difficulties with assembly. Mismatch may also adversely impact on the quality of the OMT (return loss, cross-polarization, and isolation). For these reasons, Applicant has chosen to produce examples having E-plane Y junctions on mating surfaces of the parts such that the E-plane Y junctions are defined by 2 mating surfaces on distinct blocks.

It will be noted that simulations used to provide the graphs in FIG. 4(*b*), in the case of the 3-part mitre Y junction, took into consideration a rounding of corners that result from milling with a carbide end mill, diam. 2 mm, length of cut=9 mm, where the milling is performed in the plane of the Y junction. This makes the graph of the 3-part mitre Y junction more accurate than that of the 2 step Y junction. Nonetheless, the 2 step Y junction graph shows the potential of 2+ step septum/bend Y junctions to be used with minor penalty to bandwidth and quality.

Bends

Figure 5:
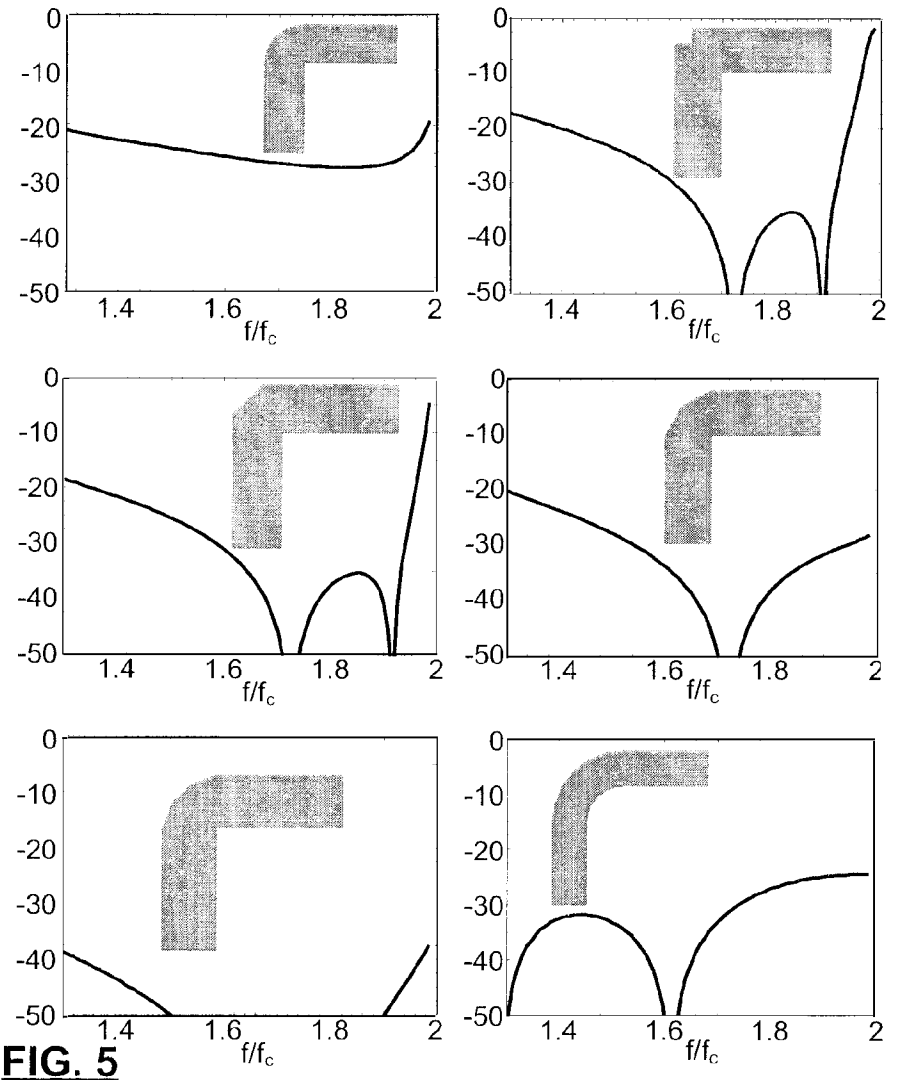
FIG. 5 shows 6 graphs of return loss ($S_{11}$ (dB)) as a function of normalized frequency for various bends that can be incorporated in an OMT in accordance with the present invention.

A variety of bends are possible, each offering different advantages in terms of return loss, and ease of machining, dependence on the orientation of the bend with respect to the mating surfaces, and whether they are E-field or H-field bends. In general there are tight corner bends, in which an inside corner of the bend is a right angle (i.e. waveguide segments of the waveguide path meet at a (usually square) edge on the inside corner) and arcuate bends, which are not as compact. FIG. 5 includes six panels, each having a return loss spectrum and an associated H-plane bend layout. The graphs are of return loss $s_{11}$ (dB) as a function of normalized frequency, as before. Similar results are provided by E-plane bends in terms of return losses. It will be noted that the return loss spectra are expressed in relative units, with respect to the cutoff frequency. While the instant graphs were produced targeting a 75-115 GHz band, as is well known in the art, a design properly scaled to a respective band has substantially equivalent overall bandwidth and return loss coefficients in other scales for other bands.

It will be noted from the top right panel that a tight corner bend with a rounded outside corner has a uniform return loss of about −20 dB over at least 1.3-1.95 relative frequency range, and is relatively flat. A single step tight corner bend or a single mitered tight corner bend has an excellent return loss (>~35 dB) from 1.65-1.9 normalized frequencies, and has −20 dB return loss between 1.35 and 1.95. A 2-miter corner and a 3 miter corner improve the overall return loss to better than −20 dB and nearly −40 dB, respectively. The foregoing bends are preferred for their compactness, and the ease with which they can be defined (i.e. using only standard CNC machining, from any of three directions) in comparison with arcuate bends. The radial arcuate bend exhibits a nearly −25 dB return loss with an inner curvature of 1.5 wavelengths. To improve this latter example the radius has to be increased, further detracting from compactness of the bend.

Square bends (tight corner with square outside edge) are also preferred; however these are difficult to produce by drilling and endmilling. Other forming techniques can be used to produce square corners, such as electroforming, as taught, for example, by Nesti in a paper entitled "Orthomode Transducer at 43 GHz", (Ufficio Innovazione Tecnologica—INAF, 2006-2007, http://www.arcetri.astro.it/~nesti/pdfs/TecRepOMT43GHz.pdf. the contents of which are incorporated herein by reference, and are understood by those of skill in the art.

Figure 5A:
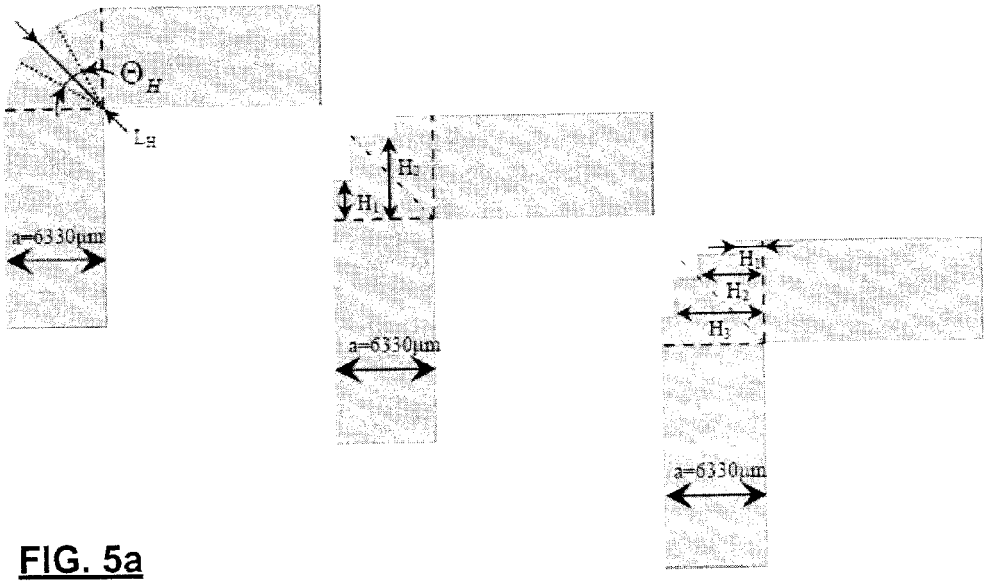
FIG. 5*a,b* respectively schematically illustrate dimensions of 3 H-plane bends and 3 E-plane bends suitable for use in an ALMA band 1 OMT.

FIG. 5*a* schematically illustrates 3 specific H-plane bends that are considered for applications in the ALMA band 1: a 3-part miter bend (the center part sweeping an angle of 30.8°, and having a width of 5.848 mm and the two symmetric side parts sweeping angles of 29.6°); a 2 step bend and a 3 step bend (both symmetric about the dashed line, having dimensions shown). For the ALMA band 1, the waveguide paths may be rectangular, having dimensions: 6.33 mm by 3.25 mm. The 3-part miter H-plane bend and 3-step H-plane bend were simulated and have return losses of −45 to −50 dB, and are below −60 dB over at least ⅔$^{rds}$ of a 40% bandwidth.

As the bends are also preferably formed by CNC machining, there will be some rounded corners (on the axis of the bit). Simulations show that the 3 step H-plane bend (with 1 mm diameter rounded corners) where the milling is performed in a direction of the E-field), exhibits a return loss of about −48 dB across a 40% bandwidth. The return loss is below −60 dB over ⅘$^{ths}$ of the 40% bandwidth. A 3 step H-plane bend (with unrounded corners), exhibits a return loss of −45 dB across a 40% bandwidth, and a return loss below 60 dB over 62% of that bandwidth.

Figure 5B:
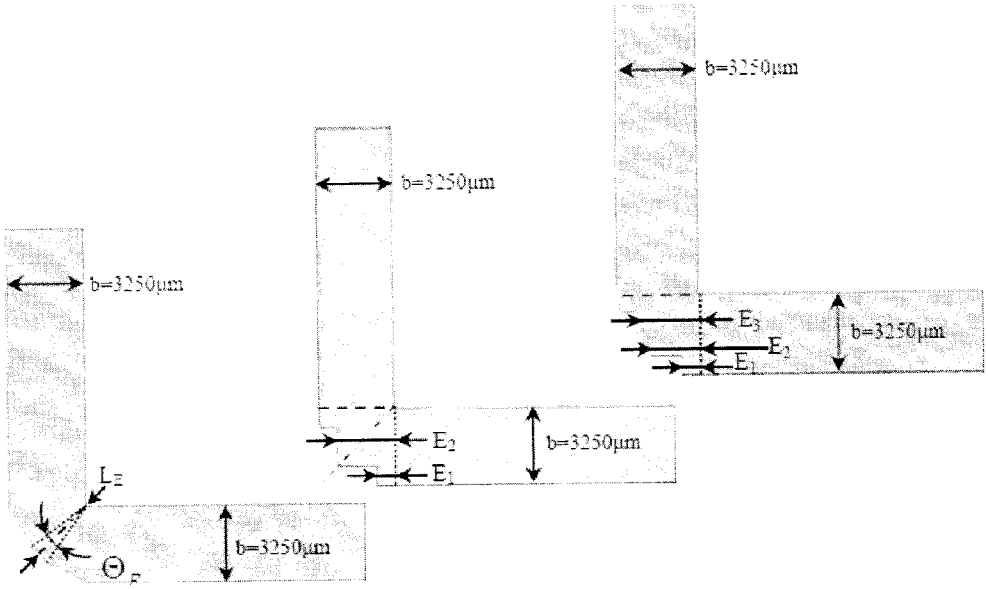

FIG. 5*b* schematically illustrates 3 specific E-plane bends that are considered for applications in the ALMA band 1: a 3-part miter bend (the center part sweeping an angle of 15.104°, and having a width of 2.8694 mm and the two symmetric side parts sweeping angles of 37.448°); a 2 step bend; and a 3 step bend (both symmetric about the dashed line, having dimensions shown). The 2 step E-plane bend (with 1 mm diameter rounded corners) where the milling is performed parallel to the E-field of one end and in the waveguide (k) direction at the other end, has a simulated return loss of −41 dB over a 40% bandwidth, over 70% of which the return loss is below −45 dB. In comparison a 3 step E-plane bend with the same rounding has a simulated return loss of −44 dB over the 40% bandwidth, and is −50 dB over nearly ⅘ths of that bandwidth, and over about half the bandwidth, is −54 dB.

A study of 2 step E-plane bends was performed to determine an importance of the diameter of the milling bit and the consequent rounding of the edges. It was noted that −32, −35, −38, −42, and −46 dB losses are provided respectively by bends with 3, 2.4, 2, 1.5, and 1 mm rounding. At 0.5 and 0 mm roundings, −54 dB return loss is provided. Similar results are expected for other bends and straight waveguide sections. Applicant has chosen the 1 mm rounding for examples described below.

Polarization Diplexed Waveguide

As is well known in the art, a matching is required between a width of the waveguide paths, and that of the diplexed waveguide and the phase constant of the signal (beta), in order for the turnstile to operate efficiently. Typically the diplexed waveguide is 2 fold symmetric (e.g. square or circular), and the waveguide paths are rectangular having a width (determining a cut-off frequency of the EM spectrum) and a height that is some fraction (½, ⅓, etc.) of the width. A transformer is typically required depending on the source and drain waveguides coupled to the OMT. To illustrate how this may be performed, a transition between a 7.9 mm to a 7.419 mm diameter (circular) polarization diplexed waveguide is used as an impedance transformer the prototype embodiment. It will be appreciated that different impedance matching transitions may be incorporated into the OMT, at the three OMT ports for example, or these may be provided outside of the OMT at adapters.

Applicant considered 3 transformer arrangements: a 3-stage Chebytchev transformer (d=7.419 mm|d=7544 mm, h=2.496 mm|d=7748 mm, h=2.458 mm|d=7.9 mm), a 3-stage polynomial transformer (d=7.419 mm|d=7527 mm, h=2.5 mm|d=7768 mm, h=2.455 mm|d=7.9 mm), and a 2 stage quarter wave transformer (d=7.419 mm|d=7644 mm, h=2.477 mm|d=7.9 mm). The return loss attributed to the quarter wave transformer element is −39 dB over a 42% bandwidth, and −50 dB over a 25% bandwidth. The polynomial transformer had a simulated return loss of −44 dB over a 42% bandwidth, with −50 dB return loss over 90% of that bandwidth and −60 dB over at least 60% thereof. The Chebytchev transformer simulation showed the best return loss, being −48 dB over the 42% bandwidth −55 dB over 92% of the bandwidth, and about −57 dB over 88% thereof.

Design Layouts

Figures 6A, 6B, 6C, 6D, 6E, 6F, 6G:
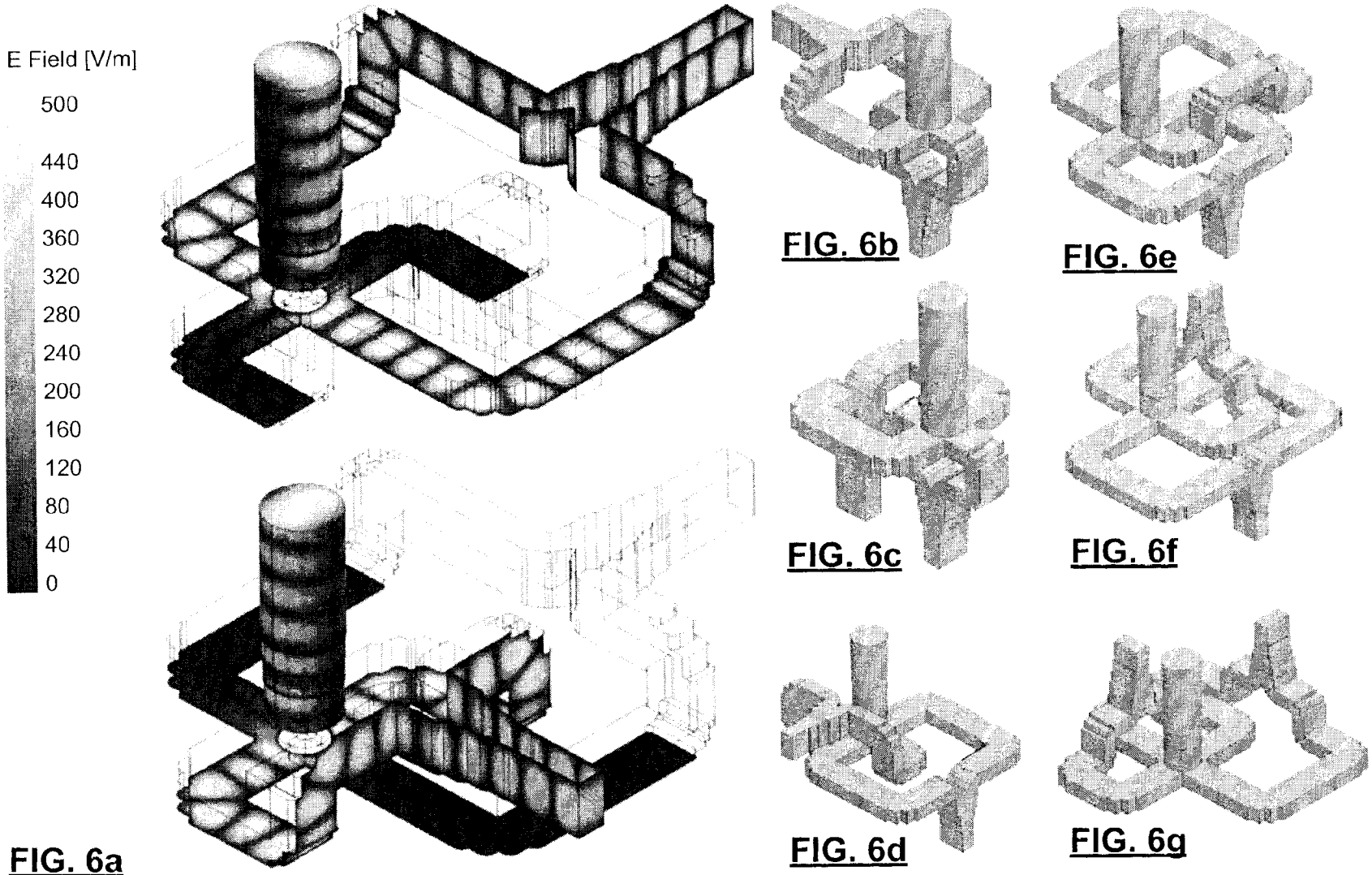
FIGS. 6*a-g* schematically illustrate 7 OMT designs in accordance with embodiments of the invention.

FIGS. 6*a-g* schematically illustrate 7 design layouts combining the above described features. FIG. 6*a* shows a first design layout of the invention, which is currently preferred because it is amenable to construction with only 3 blocks. This first design was constructed and tested, and the results are described below. This embodiment was simulated, and FIG. 6*a* shows a scalar E-field diagram of the layout, in two images. A simpler model of this design is presented in FIG. 7*a*. The 3 blocks are stacked one on top of the other. A first interface between the bottom and intermediate blocks provides the surface for the turnstile matching feature, as well as initial segments of the waveguide paths, which in both cases, consist of a straight segment, followed by an H-plane bend, followed by another straight segment, followed by the start of an E-plane bend that takes the waveguide path out of the plane of the turnstile. Through-holes in the intermediate block communicate between the E-plane bends and H-plane bends, which are aligned with respective segments that lead to respective branches of the Y junctions. Thus each waveguide path follows a bends sequence HEH. Both Y junctions, as well as the segments leading to their respective branches are defined at the interface between the intermediate and top blocks. To this degree, both arms (an arm consists of one pair of the waveguide paths that were initially oppositely directed, that extend from the turnstile to a common Y junction) of the OMT design are the same. However, it will be noted that a smaller arm is symmetric (the lengths of the segments of the waveguide paths are both abca), whereas the lengths of those of the longer arm are abcd and dbca, respectively (ignoring differences in the dimensions of the turnstile and Y junctions). The asymmetry improves compactness of the OMT. The longer arm could be longer, and symmetric.

An advantage of having the Y junctions defined at the plane above the turnstyle, as it could equally be made below the plane of the turnstile, is that the interface between the top and intermediate blocks can be used to machine the diplexed waveguide transformer. Where such a transformer is not desired, the second interface may be below the first, such that the alignment of the diplexed waveguide is controlled by the first interface independently of the alignment of the waveguide paths at the second interface. Alignment of these three blocks in a stack is easier than most other arrangements. This layout is particularly preferred for miniaturization, which is important for higher frequency OMT designs.

FIG. 6*b* schematically illustrates an alternative embodiment of a design in accordance with the invention. The design has a larger arm that is identical to the small arm of the design of FIG. 6*a*, and is not described again. The smaller arm of FIG. 6*b* is substantially optimally compact, consisting of two 90° E-plane bends between three segments. While it would be intuitive to use an H-plane Y junction to make the larger arm of the same effective size as the smaller arm, to produce a more compact design, H-plane bends are significantly lower quality bends, and are not chosen for this reason. The EE bend sequence must be defined by the plane of the turnstile and a second plane parallel to and below that of the turnstile. The longer arm extends to a plane above the turnstile, as it did in FIG. 6*a*. Accordingly, this design may be provided with a four block stack: 1) a bottom block through which the shorter arm Y junction extends, having a lower interface with a second block where the waveguide path segments connecting the waveguide paths of the shorter arm to the Y junction are defined; 2) the second block through which the waveguide paths of the shorter arm pass, defining a mid interface with a third block at which the turnstile matching feature and initial segments of the waveguide paths are defined, wherein lies the plane of the turnstile; 3) the third block having through holes for the longer arm, and forming a higher interface with a top block at which the Y junction of the longer arm is defined, and through which the transformer section of the diplexed waveguide is bored; and 4 the top block having the diplexed waveguide throughbore.

As noted in relation to FIG. 6*a*, it is convenient to provide the longer arm above the plane of the turnstile to provide access to the diplexed waveguide for forming the transformer, which is desired in many applications. However, if (for example) coupling to a variety of waveguides is desired, the transformer may be provided outside of the OMT. If so, the E-plane bends in the longer arm may be oriented downwards, instead of upwards, and the Y junction may be defined at the same block interface as the segments leading to the Y junction in the short arm. This would reduce the number of blocks to 3, obviating the higher interface between the second and top blocks. While the number of blocks increases the number of steps in assembly and alignment, the ability to independently align respective waveguide paths of the OMT may be preferred in some embodiments.

Moreover, depending on the tolerances and the requirements of the Y junction, it may be difficult or expensive to mill the shorter arm Y junction depth-wise into the bottom block. This can be avoided by adding additional blocks, so that they are stacked horizontally, or by splitting the bottom block in a direction perpendicular to the lower interface.

It will be noted that when defining an interface between two blocks (according to any embodiment), it is generally preferable to mill only one side of the interface, as this generally reduces a sensitivity of alignment, and reduces the amount of milling. At the mid interface, the milling direction is chosen by the position of the matching feature, when this is machined. If the matching feature is not milled into the piece, it may be precision aligned, for example after the OMT is assembled, at an optimal position, in which case the milling can be performed on either surface of the mid interface. But in any case, where the mid interface has bends upwards and downwards, shoulders for one of the bends would need to be milled in the otherwise flat surface. Solutions to this include: adding protruding elements on the flat surface aligned with the throughholes (for example by placing the features after the adjacent block with through holes are assembled); milling the shoulders out of the otherwise flat surface; and selecting an interface line intermediate the top and bottom walls of the waveguides. The last option requires milling in both surfaces, but generally less milling is required than in the second example. Additionally a seam is provided in the waveguides, which may be preferred.

FIG. 6*c* shows an alternative OMT design having two symmetric arms: a shorter arm corresponding to the EE bend sequence of FIG. 6*b*; and a longer arm that consists of two H-plane bends leading to the Y junction, which begins in the plane of the turnstile. This OMT design is amenable to three block formation, if longitudinal milling of the Y junctions is possible. This is not easy with standard CNC machining. Accordingly, a fourth block may be required. The four block configuration includes a stack of: a top block defining the diplexed waveguide; a middle block, through which part of the Y junction on the longer arm, and the through holes of the short arm, are defined; and a bottom block assembly that is split perpendicularly to the interfaces of the stack to pass through both Y junctions. A top interface between the top block and middle block defines the matching feature, and initial segments of the waveguide paths, as well as the top of the Y junction of the longer arm. A mid interface between the middle block and block assembly defines the top of the Y junction of the shorter arm, and parts of the waveguide paths leading thereto. A split interface of the block assembly defines the bottoms of the Y junctions. Given the aspect ratio of full height waveguides, there will generally be a requirement for milling on both sides of this split. An advantage of the embodiment of FIG. 6*c* is that both polarized outputs of the OMT are parallel.

FIG. 6*d* is an alternative OMT design including a long arm corresponding to the longer arm of FIG. 6*c* and a short arm corresponding to the shorter arm of FIG. 6*a*. This can be embodied in a three block stack having interfaces for the short arm Y junction (and transformer), and turnstile plane, and the bottom block may be split to accommodate CNC machining of the long arm Y junction. Alternatively, the long arm Y junction could be machined at an interface between a bottom block and a side block. Advantageously, by milling the bottom block on two adjacent sides, the side block would have no milling and no alignment constraints. This is a possible alternative block arrangement for all Y-couplers that extend in the direction of the diplexed waveguide, at a periphery of the OMT, in the plane of the turnstile.

FIG. 6*e* is an alternative OMT design including the HH bend sequence short arm, and a long arm having one waveguide path detouring around the short arm waveguide path with an over-pass. An over-pass can be included in other designs. The long arm consists of two waveguide paths: an HEEEEH bend sequence path, and an HH bend sequence path. These paths are non-symmetric. This embodiment can be produced with a stack of 3 (top, mid, bottom) horizontal blocks, with an upper interface between the top and mid blocks defining the over-pass of the HEEEH bend sequence path, and a lower interface between the mid and bottom blocks defining the turnstile plane. The Y junctions may be machined longitudinally into the bottom block, or on two adjacent sides of the bottom block to be covered by flat slabs, such that the bottom block is milled on three mutually adjacent sides, for example. Alternatively the lower block containing the Y junctions may be split.

FIG. 6*f* is an alternative OMT design showing a symmetric, HH bend sequence arm (although a non-symmetric arm could alternatively be chosen to make the OMT more compact, see: FIG. 6*a*, longer arm), and a symmetric arm, each waveguide path having HHEE bend sequences. This design is amenable to construction with a three block stack (top, mid, bottom), where an upper interface (top/mid) defines the "HHEE" arm Y junction and leads, the mid block defines segments of the HHEE and the lower interface (mid/bottom) defines the rest. The lower block may define the "HH" arm Y junction on a side of the block, requiring another slab, and the top block may be split to define the HHEE arm Y junction. Alternatively, this layout may be provided by a top block assembly and a bottom block (with or without the side slab), the top block assembly having a split in the plane of the HHEE arm Y junction. This split may essentially consist of a side slab, if the top block is milled on two adjacent sides. This design therefore permits construction with two blocks, each milled on 2 adjacent sides, with 2 additional slabs. While milling on two sides increases a complexity of the milling operation, it simplifies alignment considerably, and is considered preferable for some applications.

With the general design of FIG. 6*f*, a selection of (non-minimal) lengths of the waveguide paths of the HH arm and a height of the over-pass can be made to provide equal path lengths for all four waveguide paths. Alternatively, by reducing the path lengths in the HH arm, the HH arm Y junction may be shifted to lie in a plane with the Y junction of the HHEE arm, offering other options for manufacturing.

Finally, as noted above, the HHEE arm Y junction may be directed in the same direction as the HH arm Y junction, resulting in the two slabs (possibly) meeting along an edge, which could be replaced by an elbow-shaped piece.

FIG. 6*g* shows an alternative layout for an OMT, in which each waveguide path consisting of HHEE bend sequences, one of which providing an over-pass. Again path lengths may be chosen so that both arms have equal electrical lengths. Y junctions are both oriented up. The design is amenable to construction using two blocks, with a top block being milled on three mutually adjacent sides, along with two side parts and a bottom block. One of the side parts includes a part of a waveguide path that effectively provides an overpass to the short arm. The bottom has the matching feature, and may have no other feature. A side wall of the top block is milled on sides for the optical paths leading to the Y junctions. The featureless slabs may be of any material, thickness, or form to provide single walls of these waveguide paths.

While the foregoing examples used relatively few parts, up to 6 blocks can be precisely oriented, especially when the position of one block at one interface is dependent on 2 or fewer other blocks, and the mismatch of the blocks are not highest in the regions of highest sensitivity (such as the matching feature of the turnstile plane). Other embodiments are equally possible, and the foregoing are merely intended as illustrative. Other combinations of arms (HH, EE, HEH, HHEE, symmetric and non-symmetric, etc.) of the different examples are equally contemplated. It will be noted that replacing a HEH bend sequence path with an EHE bend sequence path is substantially equivalent in terms of orientation of the waveguide, and other similar substitutions are immediately obvious to those of skill in the art, and do not constitute a substantial variant of the layout.

It will be noted that while all of the foregoing examples use only straight waveguide segments, 90° bends, waveguide segments having full height, and that, except for the power transformer in the diplexed waveguide, the waveguide segments are all of constant dimension, one of skill in the art may vary from these conventional preferences, and these are not intended to be limiting, as consequences to varying these parameters can be determined using known software.

Example

To manufacture an OMT in the 30-45 GHz band, we used a conventional CNC machining with standard carbide end mills (no exotic diameters or lengths of cut). A block of aluminum was diced and surface formed by milling, and throughbores were made by drilling. The waveguide paths were rectangular, having dimensions (WR22: 6.33×3.25 $mm^2$), but this design could be used from WR-650 (1.12-1.7 GHz, 16.51×8.255 $cm^2$) to WR-3.7 (200-270 GHz, 0.94×0.47 $mm^2$) and beyond for both narrow and broadband OMTs.

Figure 7A:
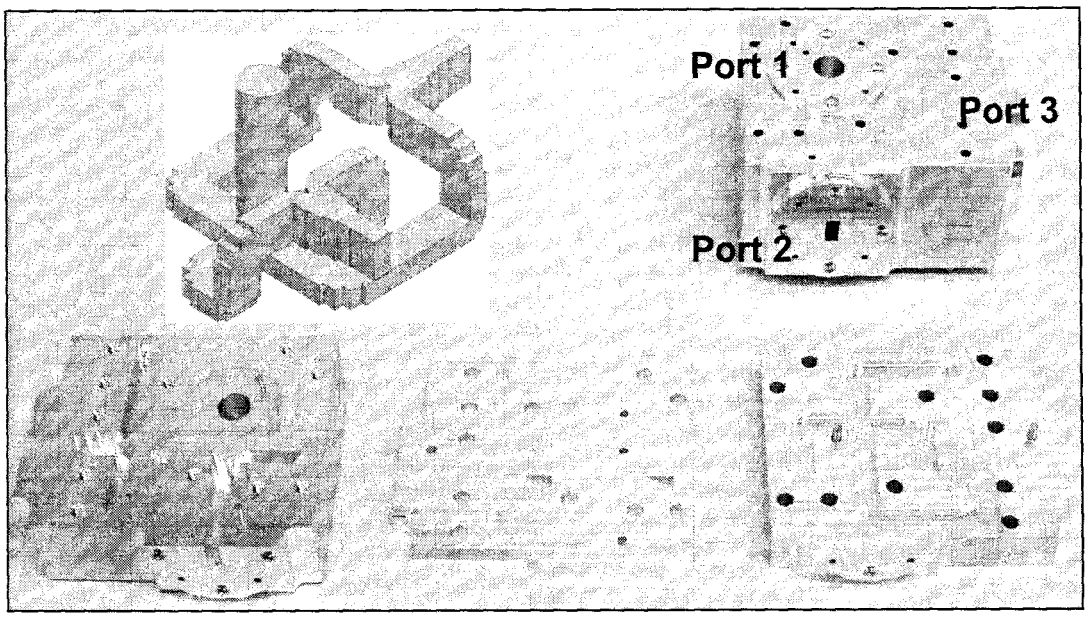
FIGS. 7*a-c* are a schematic model of, and images of a test OMT, assembled, disassembled, and mounted to test equipment for characterization.

FIG. 7*a* is a photograph of two of the OMTs produced, one in assembled, and the other in disassembled form. The turnstile plane is shown on the middle block at the far right, of the disassembled OMT, revealing the matching feature and initial segments of the waveguide paths, and H plane bends. Various holes were used for alignment of the OMT blocks. The assembly is quick and the precision of alignment is excellent. The machining tolerances were between +/−20 μm (for bends and waveguide paths outside of the plane of the turnstile) and +/−10 μm (at the plane of the turnstile). A surface roughness better than 1.6 μm for the mating surfaces was demanded. A 10 μm parallelism, perpendicularism and surface flatness were required.

Figure 7B:
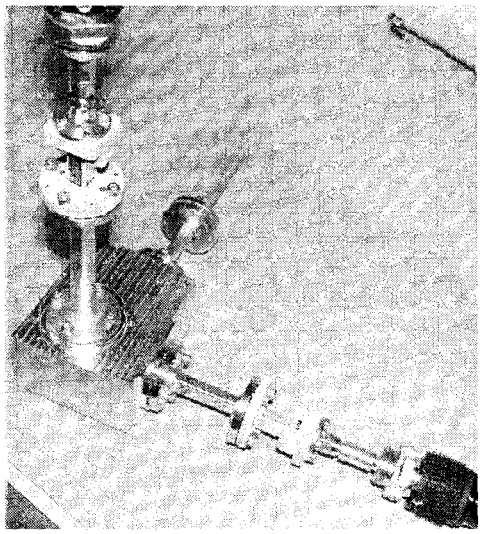

An Anritsu vector network analyzer (VNA) is used to measure s-parameters of the OMT. A schematic of the cross-polarization test setup is shown in FIG. 7*b,c*. Maury Microwave Corporation J237B6 waveguide-to-coaxial adapters were used to join the coaxial test cables to WR22 waveguides. A circular-to-rectangular waveguide adapter was used on the circular input guide. The rectangular waveguide for the orthogonal polarization was terminated with a Quinstar Tech. Inc. fixed termination.

Polarization 1 or Polarization 2 was excited by rotating the input transition by 90° at the circular waveguide flange. The Short, Short, Load, Through (SSLT) calibration procedure, well known in the art, was used to remove systematic instrumental effects and to calibrate out the response of the coaxial cables and coax-waveguide transitions in the test circuit.

Figure 7C:
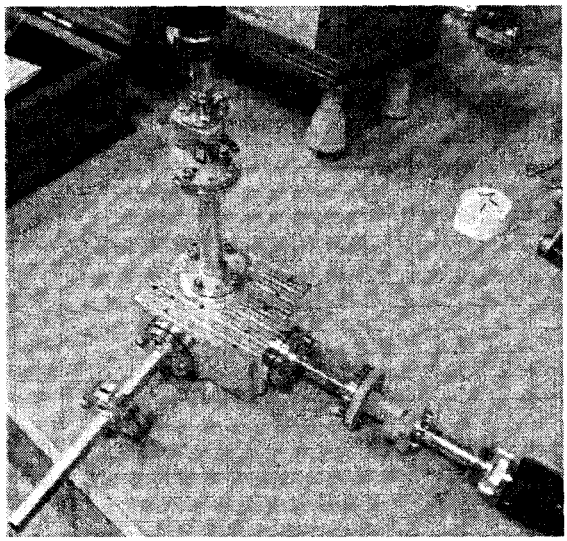
Figure 8A:
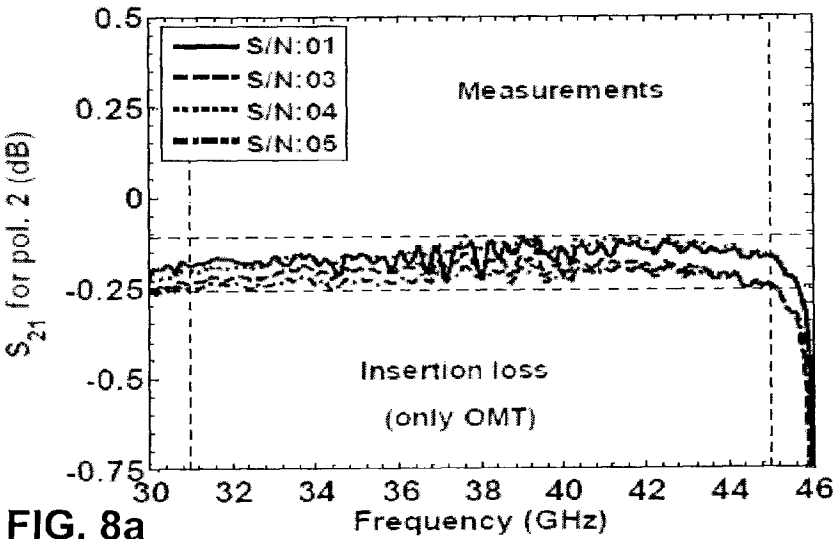
Figure 8B:
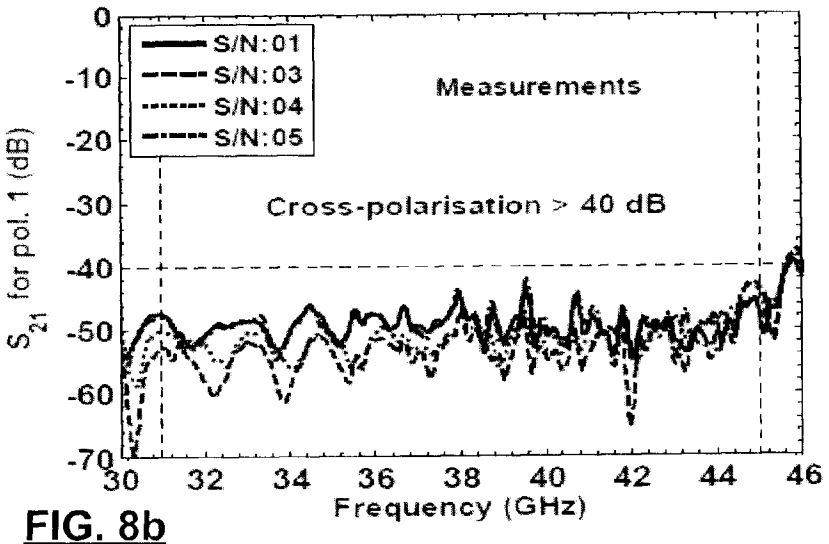
Figure 8C:
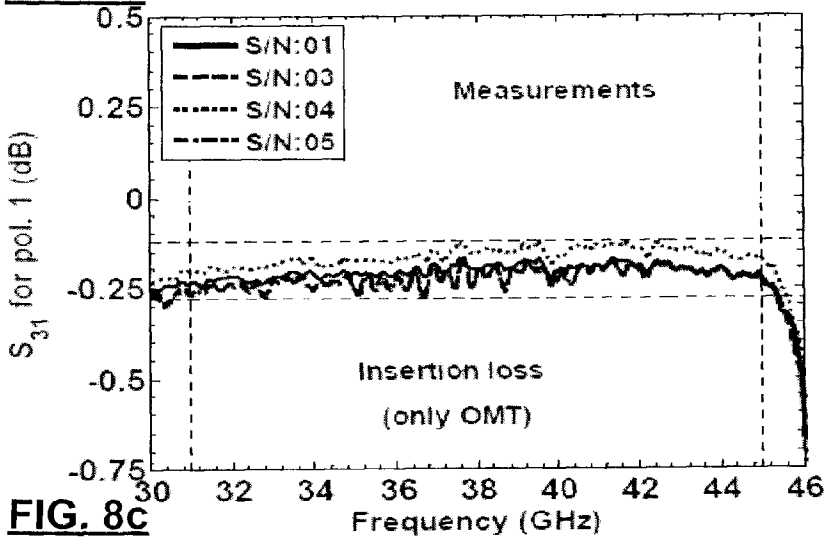
Figure 8D:
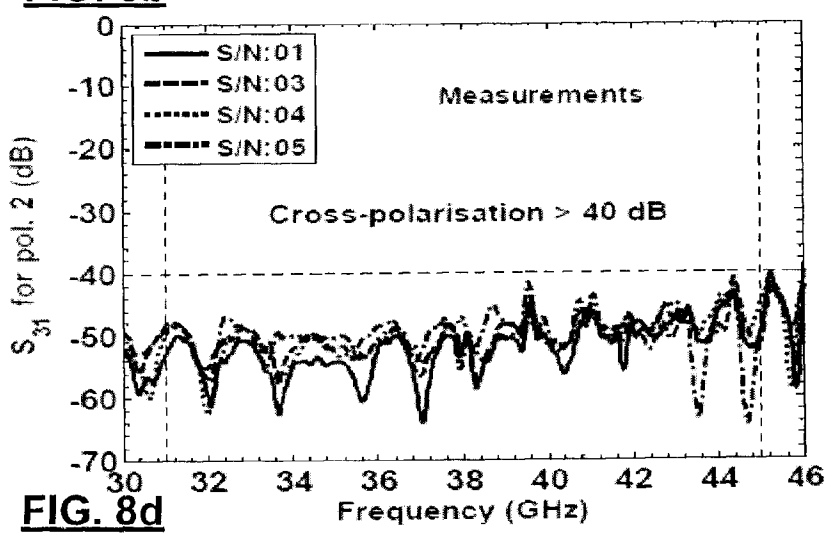

FIG. 8*a,b,c,d* are graphs showing S-parameter measurements taken on four OMT devices. It is noted that insertion loss is measured using both ports of the VNA in the configuration presented in FIG. 7*c*. The loss of the circular-to-RWG adapter was calibrated by measuring the loss of two such transitions back-to-back. The insertion loss (FIG. 8*a,c*) was between −0.11 and −0.25 dB through port 2, and between −0.12 and −0.28 dB through port 3 across the ALMA band 1 and beyond, for all four OMTs. The insertion loss is substantially flat, and reproducible across a broad 30-45 GHz (37%) bandwidth. The cross-polarization was less than −42 dB for polarization 1, and −40 dB for polarization 2 over the full 42% bandwidth shown.

FIG. 9*a,b,c* graph the return loss of each of the ports of the four OMTs. In each case the return loss is <~−25 dB, is relatively constant across the bandwidth, and highly repeatable. The polarization diplexed port (S1) shows a return loss <−27 dB.

The OMT isolation was obtained by measuring the transmissions between the OMT (uniplex) ports with its circular waveguide input port open to free space. An absorber was placed in front of the polarization diplexed waveguide. This gives an upper limit of the isolation of the device which should be measured. The isolation was found to be less than −60 dB across the ALMA band 1, and beyond.

Broadband applications (up to 44%) with return losses less than −27 dB, isolation better than −60 dB and cross-polarization better than −40 dB are shown. Narrowband applications (up to 22%) with return losses better than −30 dB, isolation better than −60 dB and cross-polarization better than −45 dB have been shown.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. An orthomode transducer, OMT, comprising:

junctions consisting of: a turnstile junction with a matching feature for electromagnetic coupling of a polarization diplexed waveguide with four waveguide paths; and two E-plane Y junctions, each Y junction coupling a pair of the waveguide paths that are oppositely directed at the turnstile junction, and paired waveguide paths extending between the turnstile junction and respective Y junctions, each waveguide path being paired with a waveguide path having a same electrical length between the turnstile and the respective E-plane Y junction;

wherein the OMT is formed in 2, 3, 4, 5, or 6 blocks, including a single block having a substantially planar surface that: meets the turnstile junction and includes the matching feature; and defines part of initial segments of the four waveguide paths.

2. The OMT according to claim 1 operable between 31-45 GHz with an isolation better than −50 dB, return losses better than −25 dB, cross-polarizations better than −40 dB, and an insertion loss from about −0.1 to about −0.3 dB.

3. The OMT according to claim 1 wherein the initial segments of both of one of the paired waveguide paths:

includes an H-plane bend;

terminates at an E-plane bend which takes the waveguide path out of a plane of the turnstile; or terminates at an E-plane Y junction which takes the waveguide path out of a plane of the turnstile.

4. The OMT according to claim 1 wherein the OMT is formed in 2 or 3 blocks by drilling throughbores in the blocks, and surface forming on at least two adjacent sides of one of the blocks.

5. The OMT according to claim 4 wherein the surface forming is performed on at least two adjacent sides of one of the blocks, and the OMT is assembled by abutting a flat surface against one of the adjacent sides.

6. The OMT according to claim 5 wherein the OMT is assembled by stacking a remainder of the blocks with the one of the blocks.

7. The OMT according to claim 5 wherein the surface forming on the one of the blocks is on at least one surface perpendicular to the diplexed waveguide, and two surfaces that are perpendicular to the at least one surface.

8. The OMT according to claim 3 wherein:

the initial segments of both of one of the paired waveguide paths includes an E-plane bend which takes the waveguide path out of a plane of the turnstile;

the initial segments of both of one of the paired waveguide paths includes an H-plane bend followed by an E-plane bend which takes the waveguide path out of a plane of the turnstile; or the initial segments of both of one of the paired waveguide paths includes a right angle H-plane bend followed by a right angle E-plane bend which takes the waveguide path out of a plane of the turnstile.

9. The OMT according to claim 1 wherein at least one of:

the E-plane Y junctions are defined by 2 mating surfaces on distinct blocks in a plane of the Y junction that includes paths of three ports of the Y junction, whereby Y junctions can be machined without high aspect ratio bits;

the E-plane Y junctions are defined by 2 mating surfaces on distinct blocks in a plane of the Y junctions, which is substantially parallel to a plane of the turnstile;

one of the E-plane Y junctions has a coupled port oriented in a direction parallel to the polarization diplexed waveguide;

both E-plane Y junctions have coupled ports oriented in a direction parallel to the polarization diplexed waveguide;

exactly one of the E-plane Y junctions has a coupled port oriented in a direction collinear with the polarization diplexed waveguide;

one of the E-plane Y junctions is in a plane parallel to a plane of the turnstile;

both of the E-plane Y junctions are in planes parallel to a plane of the turnstile; or both of the E-plane Y junctions are in a common plane parallel to a plane of the turnstile.

10. The OMT according to claim 1 wherein the matching feature comprises at least one of:

at least one cylindrical feature extending from a base towards the polarization diplexed waveguide;

at least two concentric solid cylindrical features extending from a base towards the polarization diplexed waveguide, diameters of the two concentric solid cylindrical features narrowing towards the polarization diplexed waveguide;

a stub having two solid cylinders placed along a central axis of the polarization diplexed waveguide;

a stub having two solid cylinders placed along a central axis of the polarization diplexed waveguide extending into the turnstile at a height of about 50% to about 70% a height of the waveguide paths;

a trunked solid pyramid placed along a central axis of the polarization diplexed waveguide;

a stub placed along a central axis of the polarization diplexed waveguide extending into the turnstile at a height of about 30% to about 70% a height of the waveguide paths; or a stub placed along a central axis of the polarization diplexed waveguide extending into the turnstile at a height of about 30% to about 70% a height of the waveguide paths, and further comprises one or more elements surrounding the stub substantially midway between the stub and the projection of the polarization diplexed waveguide.

11. The OMT according to claim 1 wherein one of the bends in one of the waveguide paths comprises at least one of:

a tight corner bend;

a miter bend;

a stepped corner bend;
a 2 step corner bend;
a 3 step corner bend;
a multi-part miter bend;
a 2 part miter bend;
a 3 part miter bend;
a radius bend;
one of: a stepped corner bend, and a multi-part miter bend having a return loss of −40 dB or less, and a compact profile;
one of: a stepped corner bend, and a multi-part miter bend machined by milling and/or drilling;
one of: a stepped corner bend, and a multi-part miter bend machined by milling and/or drilling wherein edges between the steps or miter parts are rounded; or
a square corner bend formed by electroforming.

12. The OMT according to claim 1 wherein one of the Y junctions comprises at least one of:
a 4 section transformer between a coupled port and a junction region;
a compact multi-part miter bend or stepped tight corner bend on each of the two decoupled ports that lead to a junction region of the Y junction;
a compact multi-part miter tight corner bend on each of the two decoupled ports that lead to a junction region of the Y junction; or
a 4 section transformer between a coupled port and a junction region, and a compact multi-part miter tight corner bend on each of the two decoupled ports that lead to a junction region of the Y junction, the Y junction exhibiting a −40 dB return loss over a 40% bandwidth.

13. The OMT according to claim 1 wherein
the OMT is formed in 3, 4, 5 blocks machined only by CNC machining.

14. The OMT according to claim 1 wherein the paired waveguide paths of one of the pairs are symmetric.

15. The OMT according to claim 1 wherein the OMT is formed in 3 blocks by only surface forming and drilling throughbores in the blocks, and the OMT is assembled by stacking the 3 blocks.

16. The OMT according to claim 15 wherein:
only two surfaces between the blocks are subject to surface forming;
only two surfaces between the blocks that are perpendicular to the diplexed waveguide are subject to surface forming;
drilling throughbores in the blocks consists in drilling throughbores in the direction of the diplexed waveguide; or
stacking is performed in a direction of the diplexed waveguide.

17. The OMT according to claim 1 wherein the OMT is formed by:
surface forming at least two mutually perpendicular sides of a first block that are not oriented perpendicular to the diplexed waveguide, drilling throughbores in the first and second blocks, and surface forming at least one surface perpendicular to the diplexed waveguide on the first or second block, stacking the first and second blocks against the at least one surface perpendicular to the diplexed waveguide, and abutting flat surfaces against two of the three mutually adjacent sides of the first block;
surface forming three mutually adjacent sides of a first block, drilling throughbores in the first block, drilling throughbores in a second block, stacking the first and second blocks, and abutting flat surfaces against two of the three mutually adjacent sides of the first block; or
surface forming on at least two adjacent sides of each of 2 blocks, and the OMT is assembled by abutting a flat surface against one of the adjacent sides of each of the 2 blocks, and stacking the 2 blocks.

18. The OMT according to claim 1 wherein one of the waveguide paths follows one of the following bend sequences: EE, HH, HHEE, HEEEEH, and HEH.

19. The OMT according to claim 1 wherein the paired waveguide paths of one of the pairs follow a same bend sequence.

20. The OMT according to claim 1 wherein:
the paired waveguide paths of one of the pairs follow a HEH bend sequence;
all waveguide paths follow a HEH bend sequence; or
the segments of one of the waveguide paths consists of uniform cross-section straight segments.

* * * * *